US005360351A

United States Patent [19]

Periou et al.

[11] Patent Number: 5,360,351

[45] Date of Patent: Nov. 1, 1994

[54] HOUSING FOR THE INTERFACE BETWEEN A MOTOR VEHICLE LOCK, ITS ACTUATOR AND THE ELECTRICAL CONNECTION HARNESS OF THE VEHICLE

[75] Inventors: Pierre Periou, Cergy Pontoise; Richard Grandjean, St Die; Bruno Laurent, St. Jean Lerlanc, all of France

[73] Assignee: Rockwell International Corporation, Pittsburgh, Pa.

[21] Appl. No.: 826,324

[22] Filed: Jan. 24, 1992

Related U.S. Application Data

[63] Continuation-in-part of Ser. No. 679,387, Apr. 2, 1991, abandoned.

[30] Foreign Application Priority Data

Apr. 4, 1990 [FR] France ..... 90 04330

[51] Int. Cl.[5] ..... H01R 13/639

[52] U.S. Cl. ..... 439/357; 439/34; 439/133; 439/304

[58] Field of Search ..... 439/650, 656, 661, 654, 439/655, 341, 357, 34, 133, 304

[56] References Cited

U.S. PATENT DOCUMENTS

| | | | |
|---|---|---|---|
| 3,824,552 | 7/1974 | Kirby | 439/357 |
| 4,487,467 | 12/1984 | Guerrero et al. | 439/271 |
| 4,688,871 | 8/1987 | Nakazawa et al. | 439/357 |
| 4,887,975 | 12/1989 | Jarred | 439/489 |
| 4,915,648 | 4/1990 | Takase et al. | 439/489 |
| 4,936,793 | 6/1990 | Uchida | 439/357 |
| 5,034,723 | 7/1991 | Maman | 439/489 |
| 5,044,975 | 9/1991 | DiBene, II et al. | 439/357 |

*Primary Examiner*—Larry I. Schwartz
*Assistant Examiner*—Hien D. Vu

[57] ABSTRACT

An actuator which is physically secured to the locking mechanism by means of a first electrical connector. The motor of the actuator is provided with power through a second electrical connector which supplies power thereto through the first connector. The second connector also provides connection to a status contactor which provides locked and unlocked status indication. In this manner, the second connector accomplishes a dual function. Consequently, fasteners as required to secure the actuator to the lock mechanism are eliminated. A modular assembly is thus produced in which the interface housing carries a single connector which can be easily connected to the cable harness of the vehicle. Therefore only one electrical connection is required when mounting the lock in the door of the vehicle.

2 Claims, 2 Drawing Sheets

HOUSING FOR THE INTERFACE BETWEEN A MOTOR VEHICLE LOCK, ITS ACTUATOR AND THE ELECTRICAL CONNECTION HARNESS OF THE VEHICLE

BACKGROUND OF THE INVENTION

This application is a continuation-in-part of patent application Ser. No. 07/679,387, filed Apr. 2, 1991 based on French foreign priority application Serial No. 90 04 330, filed Apr. 4, 1990.

FIELD OF THE INVENTION

The present invention relates to a housing defining an interface between a motor vehicle lock, an actuator and an electrical connection harness, and also to the assembly formed by association of this housing, the lock and the actuator.

DESCRIPTION OF THE RELATED ART

It is known an automobile locks as shown in FIG. 1, which incorporate a remote actuation feature that an actuator 30 must be mounted to the lock 10 and fastened by screws 15 or by clipping. In addition, the electrical cable harness 20 of the vehicle must be connected to the actuator 30 in order to supply the motor of the actuator with power. A second electrical connection 21 is required to connect the electrical cable harness to detection contactors 22, 22 which provide lock status indication. It is therefore necessary to provide a number of connections for electrical connection to the lock in addition to providing mechanical fasteners to secure the actuator to the lock itself. The object of the present invention is to combine the function of the electrical connection and mechanical fasteners by using an electrical connection that also provides a structural connection. The advantage is that a single connection to the electrical harness is achieved and all mechanical fasteners are eliminated by a dual purpose electrical connection.

SUMMARY OF THE PRESENT INVENTION

The present invention incorporates an actuator which is physically secured to the locking mechanism by means of a first electrical connector. The motor of the actuator is provided with power through a second electrical connector which supplies power thereto through the first connector. The second connector also provides connection to a status contactor which provides locked and unlocked status indication. In this manner, the second connector accomplishes a dual function. Consequently, fasteners required to secure the actuator to the lock mechanism are eliminated. A modular assembly is thus produced in which the interface housing carries a single connector which can be easily connected to the cable harness of the vehicle. Therefore only one electrical connection is required when mounting the lock in the door of the vehicle.

The preferred embodiment of the present invention includes a modular vehicle lock assembly including an actuator, a vehicle lock including position detector contacts, first means for connecting the lock and the actuator providing structural securance and electrical communication therebetween and second means for connecting the assembly to a vehicle wiring harness for providing power to the actuator and determining status of the detector contacts. Further, the means for connection includes male pins engaging female sockets and structurally engaging and locking members. In addition, the second means for connection comprises electrical connectors. The preferred embodiment of the present invention may be assembled by engaging the actuator finger with a fork of the lock coincident with engagement of the first means for connecting the lock and the actuator.

These and other aspects of the present invention will become more readily apparent by reference to the following detailed description of the embodiments as shown in the drawings.

DETAILED DESCRIPTION OF THE PREFERRED EMBODIMENT

Figure 1:
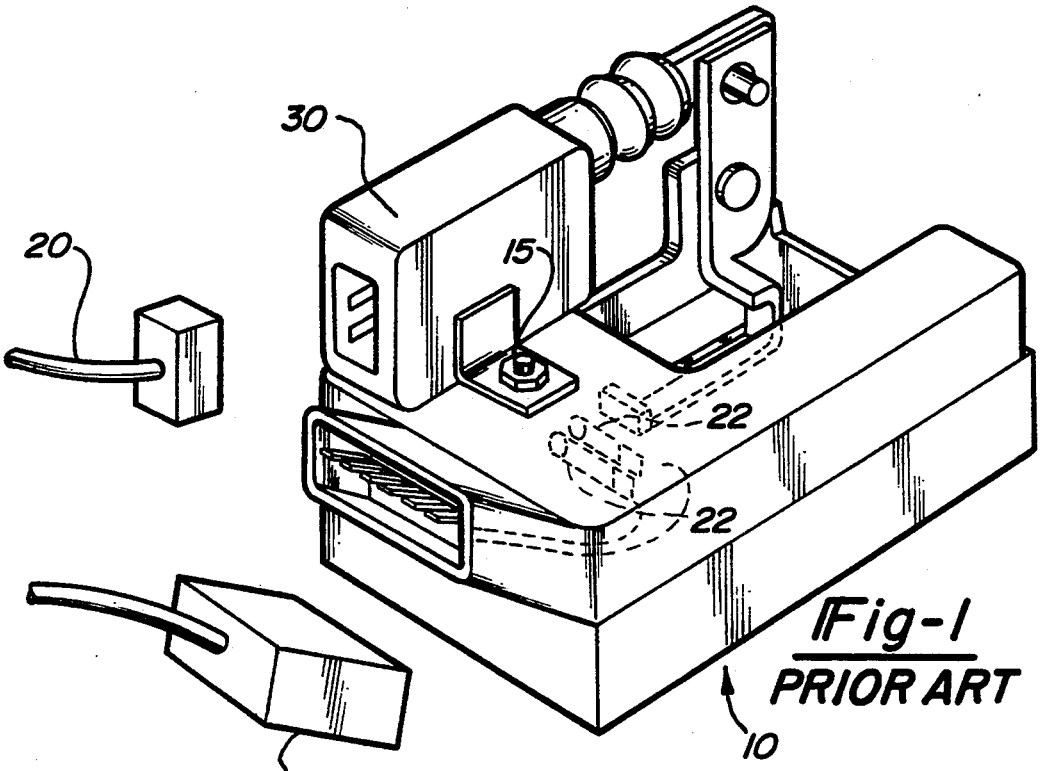
Fig-1 PRIOR ART
FIG. 1 is an exploded perspective view of the prior art embodiment of the present invention.
Figure 2:
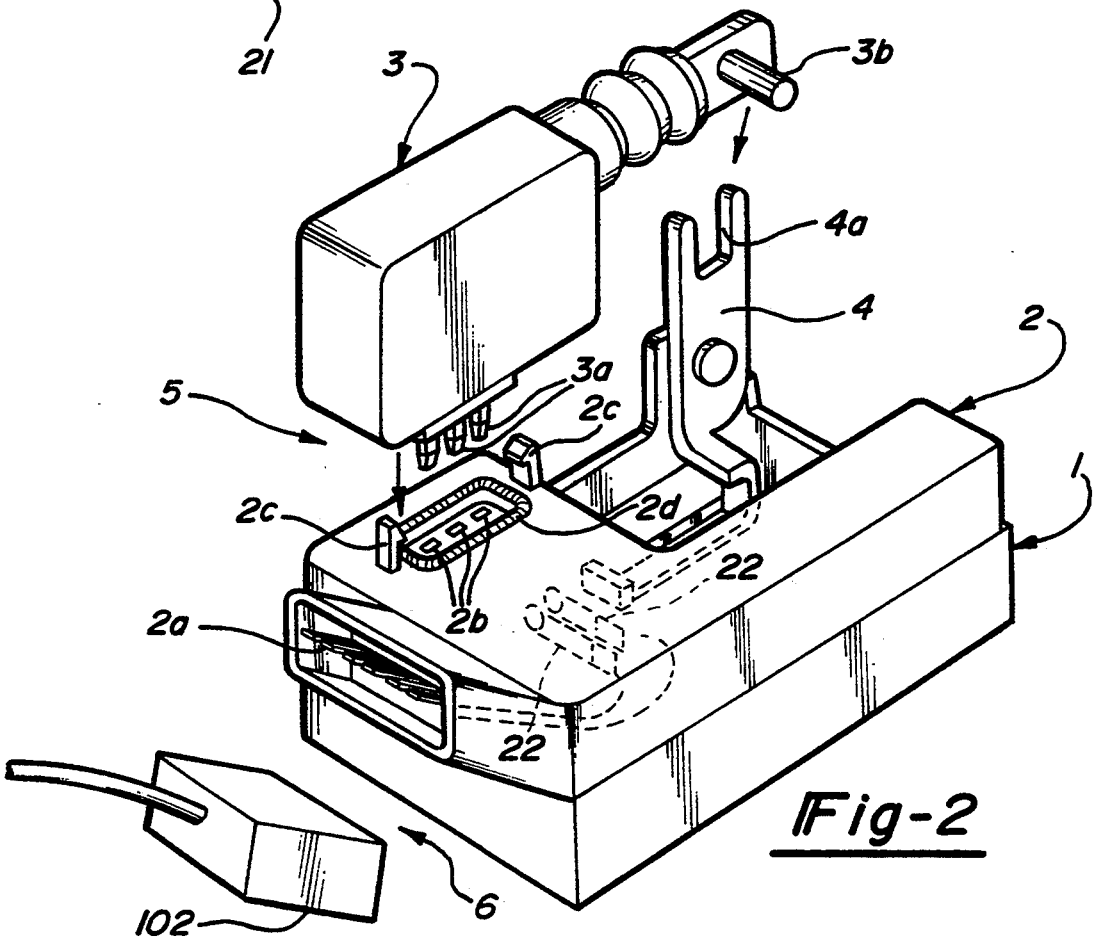
FIG. 2 is an exploded perspective view of an embodiment of the interface housing provided by the present invention.
Figure 3:
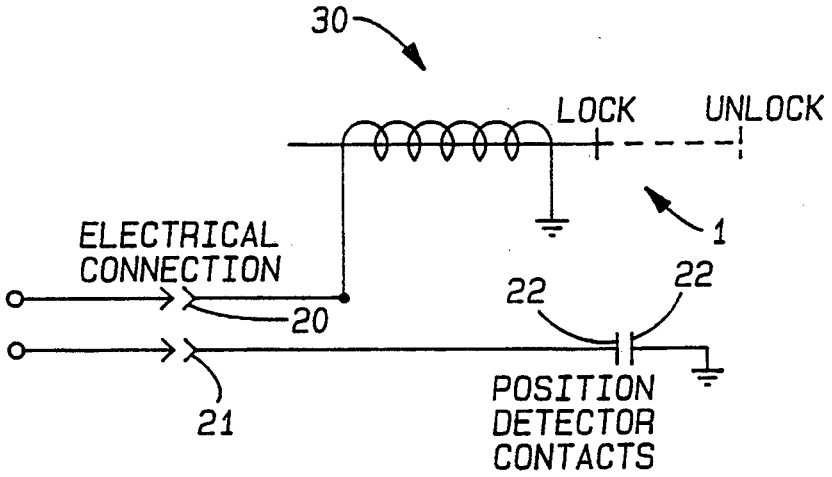
FIG. 3 is a schematic view of the operation of the prior art.
Figure 4:
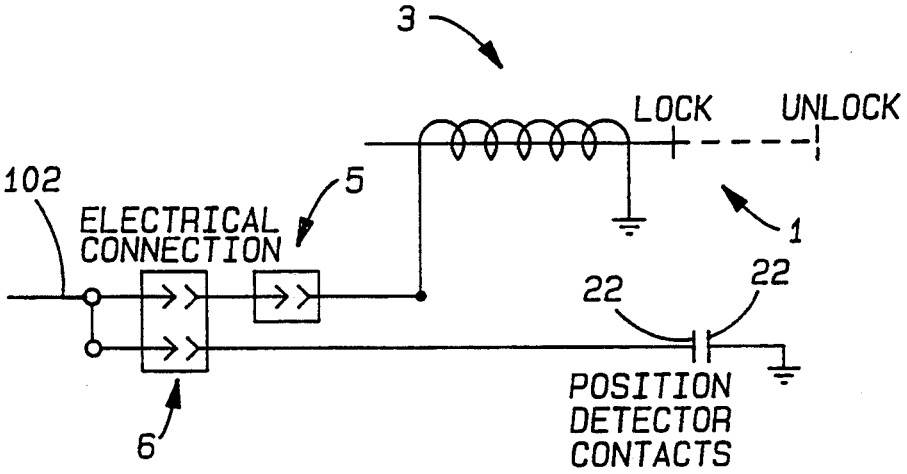
FIG. 4 is a schematic view of the operation of the present invention.

The preferred embodiment of the present invention (as shown in FIG. 2) incorporates a lock of 1 of conventional design which is structurally secured to housing 2 and defines a location for securance of actuator 3. Housing 2 which contains lock position detector contacts 22, 22 shown in FIGS. 1, 2 and 4, can be fastened to lock 1 by known clipping means **2*c* as shown in FIG. 2. Housing 2 includes two connections 5, 6. The connection 6 uses connection device 2*a*, formed by a series of male pins which can be connected to the cable harness 102 of the vehicle, whereas the connection 5 uses connection device 2*b*, here formed by three female sockets which receives three corresponding blade terminals 3*a* of the actuator 3 when the latter is fitted to housing 2. Housing 2 carries clips 2*c*, 2*c* formed as two projections lugs, each being capable of cooperating with complimentary female elements (not show) of actuator 3, when the latter is pinned and locked to housing 2. Housing 2 includes seal 2*d* to insure sealing of the connection with actuator 3. Locking transmission lever 4 of lock 1 and actuator 3 are provided respectively with forms, such as fork 4*a* ad finger 3*b*, facilitating assembly of actuator 3 to housing 2, while at the same time insuring engagement of the mechanical linkage of the locking transmission lever 4. The assembly formed in this manner features the following advantages; a single connection 2*a* to the cable harness of the vehicle is sufficient for all the electrical functions with the result that the lock 1 can be mounted in the door of the vehicle by a single operation for connection to harness 102 and the actuator 3 is secured to lock 1 in an economical manner. Electrical contacts 22, 22 functioning as position detector contacts, shown in FIGS. 1, 2 and 4, provide indicia via electrical harness 21 or alternatively 102 of the position of actuator 3. FIG. 3 illustrates a schematic diagram of a prior art actuator and lock system typically secured by fasteners which includes electrical connections 20, 21 and an actuator 30 providing motive force to accomplish lock and unlock position for lock 1. A separate connection to the wire harness is achieved by electrical connection 21 to position detector contacts 22, 22 which provide indicia of the position of lock 1. FIG. 4 illustrates the preset invention featuring a combined electrical and structural connection 5 and a singular harness connection device 6. Actuator 3 provides motive force to accomplish lock and unlock position for lock 1. In addition, the singular harness connection device 6 provides electrical connection of the harness to position detector contacts 22, 22**.

One skilled in the art will readily recognize that certain specific details shown in the foregoing specification and drawings are exemplary in nature and subject to modification without departing from the teachings of the disclosure. Various modifications of the invention discussed in the foregoing description will become apparent to those skilled in the art. All such variations that basically rely on the teachings through which the invention has advanced the art are properly considered within the spirit and scope of the invention.

I claim:

1. A modular vehicle lock assembly comprising:

an actuator;

a vehicle lock including position detector contacts;

first means for connecting said lock and said actuator upon engagement therebetween providing structural securance and electrical communication therebetween;

second means for connecting said assembly to a vehicle wiring harness for providing power to said actuator and determining status of said detector contacts; and wherein said actuator includes a finger which slidingly engages with a fork of said lock simultaneously with engagement of said lock and said actuator by said first means.

2. The invention of claim 1 wherein said first means for connection includes male pins engaging female sockets and engaging clips.

* * * * *